US010483621B2

(12) United States Patent
Rashidian

(10) Patent No.: US 10,483,621 B2
(45) Date of Patent: Nov. 19, 2019

(54) ANTENNA AND WIRELESS COMMUNICATIONS ASSEMBLY

(71) Applicant: PERASO TECHNOLOGIES INC., Toronto (CA)

(72) Inventor: Atabak Rashidian, North York (CA)

(73) Assignee: PERASO TECHNOLOGIES INC., Toronto (CA)

( * ) Notice: Subject to any disclaimer, the term of this patent is extended or adjusted under 35 U.S.C. 154(b) by 306 days.

(21) Appl. No.: 15/331,072

(22) Filed: Oct. 21, 2016

(65) Prior Publication Data

US 2018/0115056 A1 Apr. 26, 2018

(51) Int. Cl.

| | |
|---|---|
| ***H01Q 1/24*** | (2006.01) |
| ***H01Q 5/385*** | (2015.01) |
| ***H01Q 1/52*** | (2006.01) |
| ***H01Q 9/04*** | (2006.01) |

(52) U.S. Cl.

CPC ..... *H01Q 1/243* (2013.01); *H01Q 1/525* (2013.01); *H01Q 5/385* (2015.01); *H01Q 9/045* (2013.01)

(58) Field of Classification Search

CPC ..... H01Q 1/525; H01Q 5/385

See application file for complete search history.

(56) References Cited

U.S. PATENT DOCUMENTS

| | | | | |
|---|---|---|---|---|
| 4,460,894 | A * | 7/1984 | Robin | H01Q 1/523 343/700 MS |
| 7,924,227 | B2 * | 4/2011 | Yamada | H01Q 9/0407 343/700 MS |
| 8,654,011 | B2 * | 2/2014 | Eom | H01Q 21/065 343/700 MS |
| 9,806,422 | B2 * | 10/2017 | Garcia | H01Q 21/28 |
| 2014/0285383 | A1 * | 9/2014 | Fakharzadeh | H01P 5/107 343/702 |

* cited by examiner

*Primary Examiner* — Jessica Han
*Assistant Examiner* — Amal Patel
(74) *Attorney, Agent, or Firm* — Perry + Currier Inc.

(57) ABSTRACT

An antenna assembly includes a support member having opposing first and second surfaces, and a set of electrical contacts; an antenna carried on the first surface of the support member and electrically connected to the set of electrical contacts; a conductive inner ring element carried on the first surface and surrounding the antenna; and a dielectric outer ring element mounted on the first surface and surrounding the conductive inner ring.

20 Claims, 6 Drawing Sheets

ANTENNA AND WIRELESS COMMUNICATIONS ASSEMBLY

FIELD

The specification relates generally to wireless communications, and specifically to an antenna assembly and associated wireless communication assembly.

BACKGROUND

Printed wireless antennas are employed in a variety of applications, including mobile computing devices (e.g. smart phones) and wireless adapters connectable to computing devices (e.g. desktop computers, "smart" televisions and the like) to enable wireless communication with those devices. Patch elements are common in such antennas; a conventional approach employed to increase the gain or frequency response of a wireless antenna is to replace a single patch (or indeed other types of antenna element) with an array of patches.

Arrays of antenna elements, however, require complex networks of feed lines. In addition to the increased complexity—and therefore cost—of manufacturing such feed line networks, the feed lines can also result in undesirable interference (e.g. due to mutual coupling between the feed lines and the antenna elements), and in undesirably reduced impedance bandwidth. These difficulties are particularly severe at higher frequencies, such as those employed by the IEEE 802.11ad wireless communications standard (also referred to as WiGig™), which prescribes channels having frequencies of about 58 GHz, 60 GHz, 62 GHz and 64 GHz.

SUMMARY

According to an aspect of the specification, an antenna assembly is provided, including a support member having opposing first and second surfaces, and a set of electrical contacts; an antenna carried on the first surface of the support member and electrically connected to the set of electrical contacts; a conductive inner ring element carried on the first surface and surrounding the antenna; and a dielectric outer ring element mounted on the first surface and surrounding the conductive inner ring.

BRIEF DESCRIPTIONS OF THE DRAWINGS

Embodiments are described with reference to the following figures, in which.

DETAILED DESCRIPTION OF THE EMBODIMENTS

Figure 1:
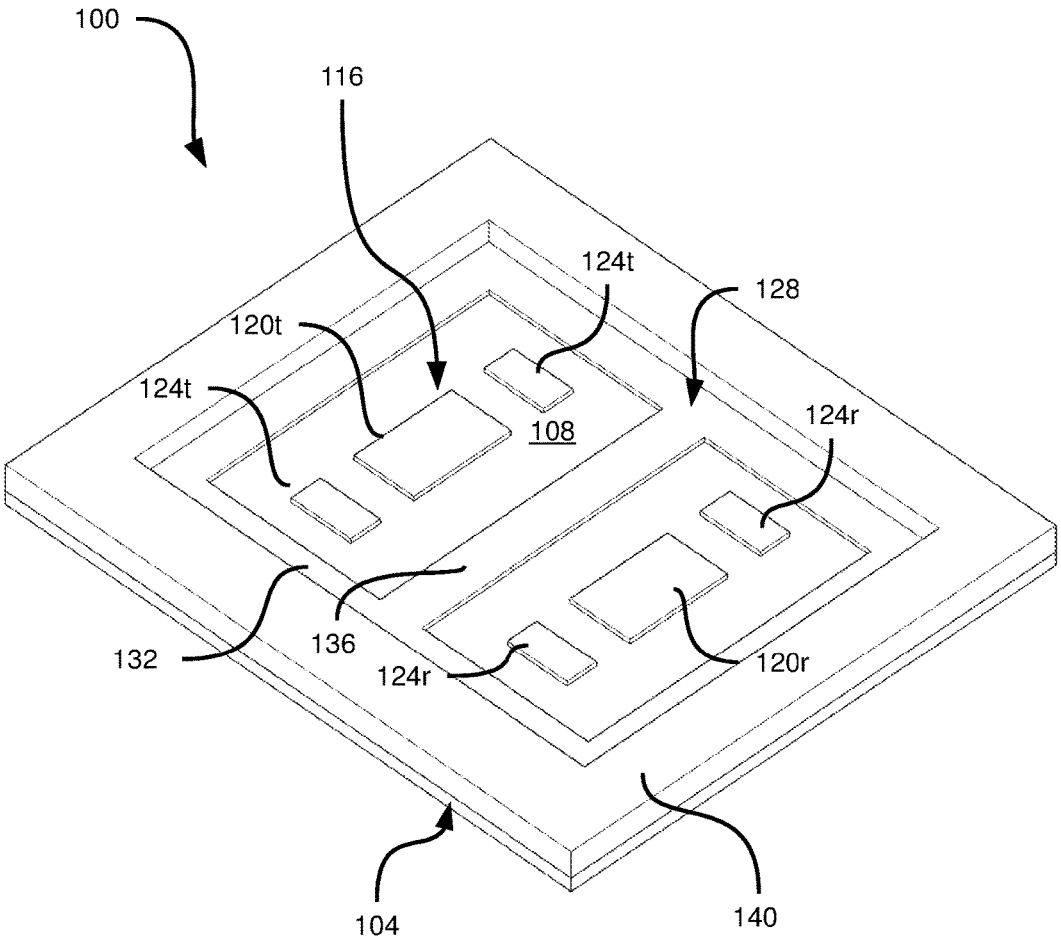
FIG. 1 depicts an top isometric view of an antenna assembly, according to a non-limiting embodiment.
Figure 2:
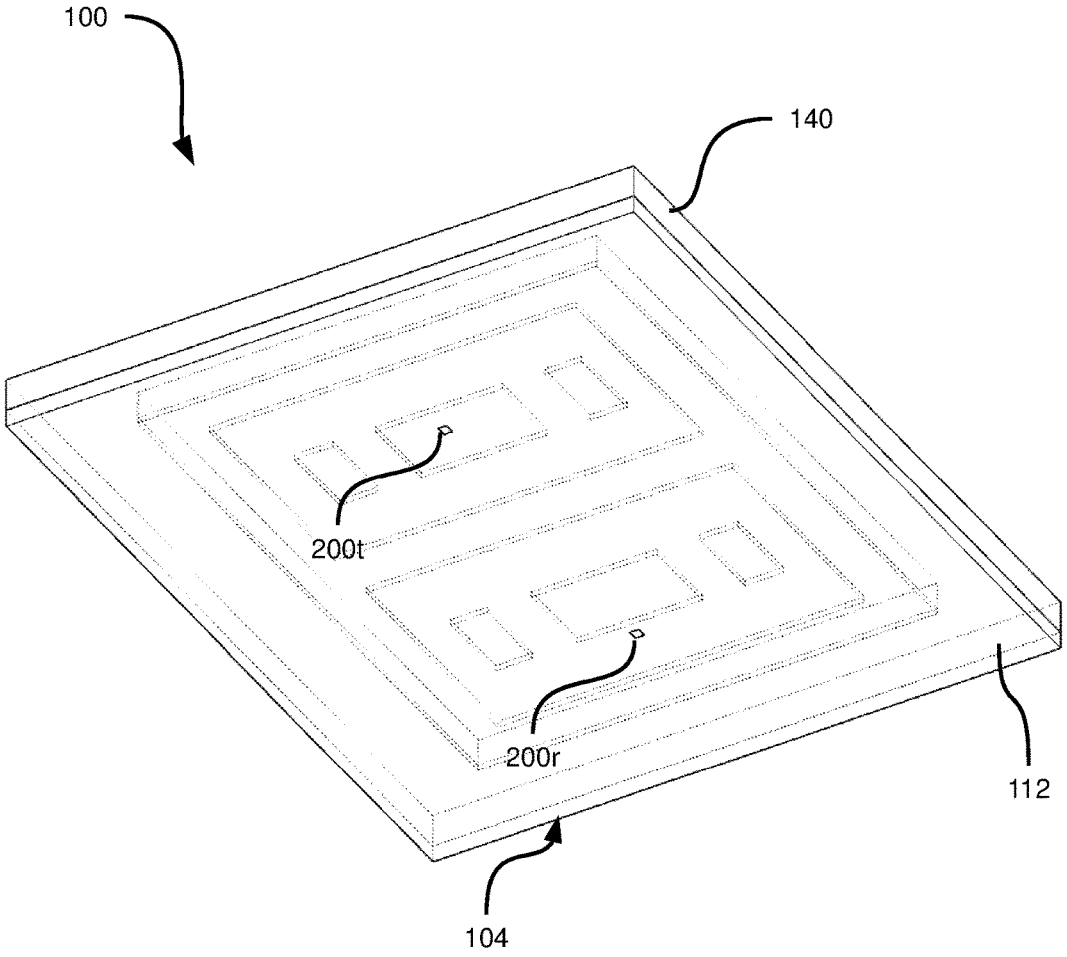
FIG. 2 depicts a bottom isometric view of the antenna assembly of FIG. 1, according to a non-limiting embodiment.
Figure 3:
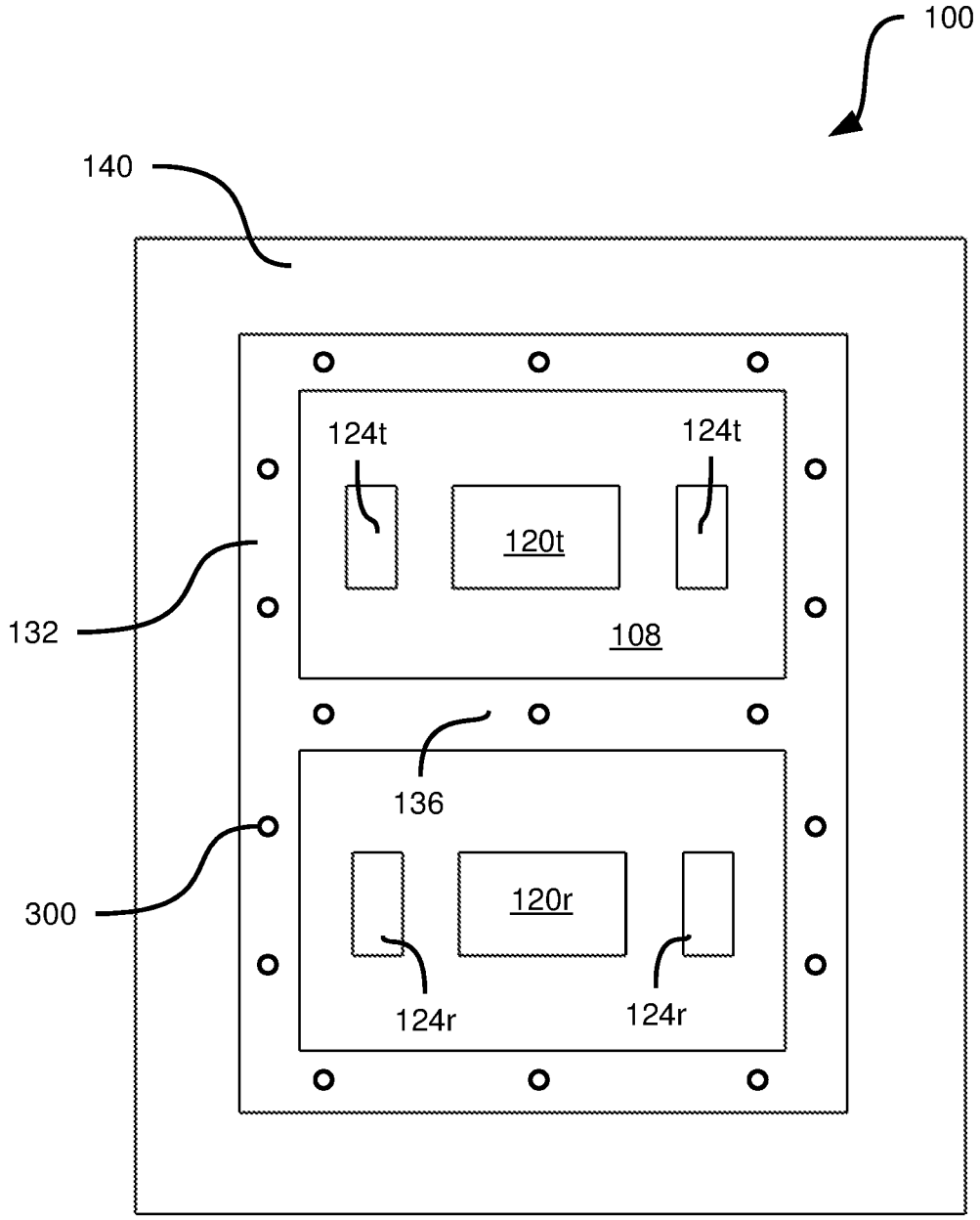
FIG. 3 depicts a top plan view of the antenna assembly of FIG. 1, according to a non-limiting embodiment.

FIGS. 1, 2, and 3 depict an antenna assembly 100 for a wireless communications assembly to be discussed in greater detail below. In general, antenna assembly 100 enables the a computing device connected to the wireless communications assembly to exchange data with other computing devices. Such data exchange may be conducted over a variety of communication protocols. In the present embodiment, antenna assembly 100 and the associated wireless communications assemblies discussed later are configured to enable communication using the IEEE 802.11ad standard, and thus transmit and receive data are around 60 GHz.

Antenna assembly 100 includes a support member 104, such as a printed circuit board (PCB) substrate, having a first surface or side 108 (shown in FIG. 1), and an opposing second surface or side 112 (shown in FIG. 2). Support member 104 can be fabricated from any suitable PCB substrate. In the present embodiment, in which antenna assembly 100 is to be operated in the 60 GHz band, materials with attributes desirable for high-frequency operation are preferable, such as Megtron. Although antenna assembly 100 can be implemented with any suitable number of layers (that is, layers of conductive material, such as copper plating) and intervening dielectric layers, in the present embodiment support member 104 is a two-layer member, having conductive material on surfaces 108 and 112 (from which various elements of assembly 100 are fabricated, as will be discussed below), and a dielectric material separating surfaces 108 and 112.

Support member 104 includes a set of electrical contacts. In the present embodiment, as illustrated in FIG. 2, a pair of electrical contacts 200*t* and 200*r* are disposed on second surface 112 (e.g. etched from the copper layer on surface 112, the remainder of which may form a ground plane).

Antenna assembly 100 also includes an antenna 116 carried on first surface 108. Antenna 116, in the present embodiment, is etched from the copper (or other conductive material) layer of first surface 108. Antenna 116 includes a transmission element 120*t* connected to electrical contact 200*t*, and a reception element 120*r* connected to electrical contact 200*r*. Antenna elements 120*t* and 120*r* are collectively referred to as antenna elements 120 herein. As will now be apparent, in the present embodiment, in which contacts 200 are on the opposite side of support member 104 from antenna elements 120, antenna elements 120 are connected to contacts 200 by vias extending through support member 104 from surface 108 to surface 112.

As will also be apparent from FIG. 1, antenna elements 120 are patch antenna elements. Further, antenna 116 also includes parasitic patch elements in the form of at least one transmission parasitic element and at least one reception parasitic element. In the illustrated embodiment, two transmission parasitic elements 124*t* are disposed on opposite sides of transmission element 120*t*, and two reception parasitic elements 124*r* are disposed on opposite sides of reception element 120*r*.

Antenna 116 (that is, elements 120 and 124) is of conventional design. That is, the size and spacing of the powered elements (120*t*, 120*r*) and the parasitic elements (124*t*, 124*r*) are selected according to any suitable parasitic patch antenna design available to those skilled in the art. Antenna assembly 100 also includes, however, several non-conventional structural features.

In addition to antenna 116, antenna assembly 100 includes a conductive inner ring element 128 carried on first surface 108 and surrounding antenna 116. In the present embodiment, conductive inner ring element 128 is etched from the same copper layer as antenna 116. In other embodiments, when deposition is employed to manufacture support member 104, antenna 116 and ring element 128, ring element 128 can be deposited in the same deposition process as antenna 116. Conductive ring element 128 is a copper element in the present embodiment, but can also be fabricated of any other suitable conductive material (e.g. gold or any other suitable conductive metal).

Conductive inner ring 128, in the illustrated embodiment, continuously surrounds antenna 116. In other embodiments, however, conductive inner ring 128 may include one of more breaks therein so as to substantially, but not entirely, surround antenna 116. For example, conductive inner ring 128 may include breaks having a combined length of less than about ten percent of the length of the outer perimeter of conductive inner ring 128.

Further, in the present embodiment, conductive inner ring 128 separately surrounds the transmission elements 120*t*, 124*t* and the reception elements 120*r*, 124*r* of antenna 116. More specifically, conductive inner ring 128 includes a ring 132 encircling the entirely of antenna 116 (that is, surrounding both transmission and reception elements together). Conductive inner ring 128 also includes a divider 136 extending from a first side of ring 132 to a second, opposite side of ring 132. Divider 136 extends between the transmission elements of antenna 116 and the reception elements of antenna 116. Thus, transmission elements 120*t* and 124*t* are surrounded by divider 136 and a portion of ring 132, while reception elements 120*r* and 124*r* and surrounded separately from the transmission elements by divider 136 and the remaining portion of ring 132. In some embodiments, divider 136 can be omitted.

Antenna assembly 100 also includes a dielectric outer ring 140 mounted on first surface 108 and surrounding conductive inner ring 128 (and therefore also surrounding antenna 116). Dielectric outer ring 140 is fabricated from any suitable dielectric material. Outer ring 140 can be fabricated from the same material as the substrate of support member 104 (e.g. Megtron), or from a different dielectric material. In the present embodiment, outer ring 140 is fabricated from a dielectric material without attributes desirable for high-frequency operation, such as FR4, due to the lower cost of such materials. While the high-frequency performance of the substrate material employed in support member 104 can impact the performance of antenna 116, it has been determined that the high-frequency performance of the material employed for outer ring 140 has little or not impact on antenna performance.

Dielectric outer ring 140 can be manufactured separately from support member 104, antenna 116 and inner ring 128, and mounted on surface 108 using any suitable means (e.g. adhesive, heat bonding or a combination thereof). As best seen in FIG. 3, in the present embodiment, the inner perimeter of dielectric outer ring 140 is in contact with the outer perimeter of conductive inner ring 128. In other embodiments, conductive inner ring 128 and dielectric outer ring 140 can be separated from each other on surface 108.

Returning to FIG. 1, dielectric outer ring 140 is configured as a wall rising from surface 108 of support member 104. In particular, dielectric outer ring 140 rises from surface 108 to a height greater than the height of the elements of antenna 116 and conductive inner ring 128. By way of non-limiting example, in the present embodiment outer ring 140 has a height of about 0.5 mm, measured from surface 108. Further, by way of non-limiting example, outer ring 140 has a width of about 2 mm, while inner ring 128 has a width of about 1 mm. As will now be apparent, the height of inner ring 128 above surface 108 is determined by the thickness of the metal layer on support member 104 from which inner ring 128 was etched. The height of inner ring 128 (and the elements of antenna 116) is typically between 0.02 mm and 0.05 mm. As will be apparent to those skilled in the art, the height of antenna 116 elements and inner ring 128 is exaggerated in the drawings.

Although support member 104 and outer ring 140 are illustrated as having the same outer perimeters, in other embodiments, support member 104 can have a larger perimeter than outer ring 140. In such embodiments, contacts 200*r* and 200*t* can also be placed on surface 108, outside outer ring 140 (that is, so that outer ring 140 is between contacts 200 and antenna 116). In such embodiments, contacts 200 are connected to antenna 116 by multiple vias (e.g. a via from antenna element 120*t* to surface 112, a trace along surface 112, and another via back to surface 108).

Referring to FIG. 3, antenna assembly 100 also includes a plurality of ground vias 300 connecting conductive inner ring 128 to the ground plane on surface 112. The number and spacing of ground vias 300 is not particularly limited. For example, while only seventeen ground vias 300 are illustrated in FIG. 3, in some embodiments about one hundred ground vias 300 can be provided, either equally spaced along ring 132 and divider 136, or spaced unequally.

Figure 4A:
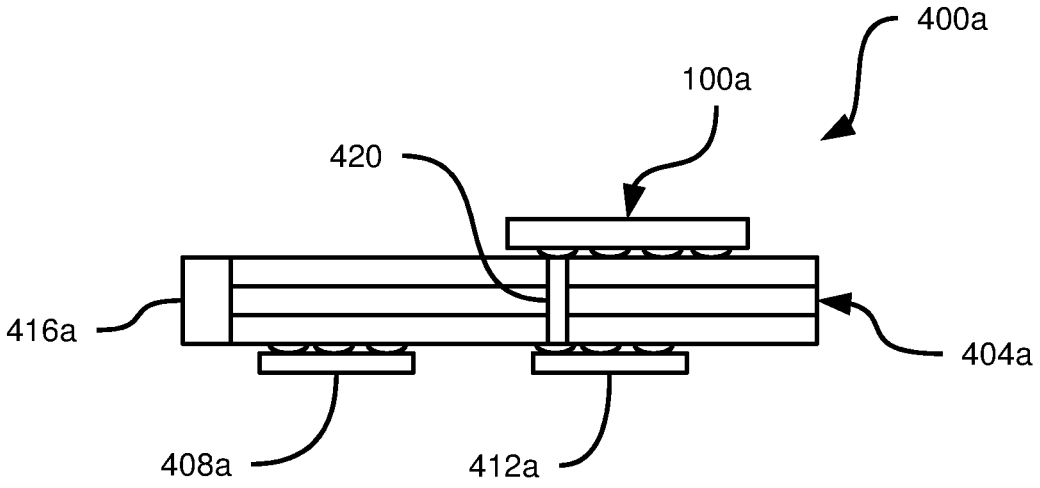
FIG. 4A depicts a cross-sectional view of a wireless communications assembly, according to a non-limiting embodiment.
Figure 4B:
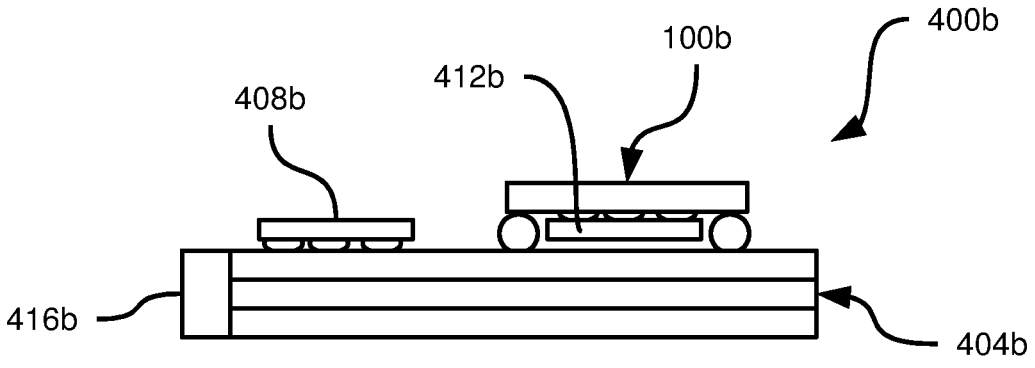
FIG. 4B depicts a cross-sectional view of a wireless communications assembly, according to another non-limiting embodiment.

As will be apparent, the transmission element 120*t* of antenna 116 receives a signal delivered to antenna assembly 100 from processing hardware at contact 200*t*, and emits radiation based on the signal. Reception element 120*r* of antenna 116, on the other hand, receives radiation and generates an output signal representing that radiation. The output signal is applied to contact 200*r* for delivery to the processing hardware. Turning now to FIGS. 4A and 4B, examples of communications assemblies including both antenna assembly 100 and the above-mentioned processing hardware will be described.

FIGS. 4A and 4B depict cross-sectional views of wireless communications assemblies. In particular, FIG. 4A depicts a wireless communications assembly 400*a* and FIG. 4B depicts a wireless communications assembly 400*b*.

Each assembly 400 includes an assembly support member 404*a*, 404*b*, which in the present embodiment are four-layer PCBs. Each assembly 400 also includes a baseband processor 408*a*, 408*b* carried by support member 404*a*, 404*b* respectively. Baseband processors 408 are conventional baseband processors consisting of one or more integrated circuits mounted to assembly support members 404 by any suitable mounting technology (e.g. ball-grid array, or BGA).

Each assembly 400 also includes a radio processor 412*a*, 412*b*. Radio processors 412*a* and 412*b* are electrically connected to baseband processors 408*a*, 408*b*. However, as will be discussed below, the nature of the connection between radio and baseband processors varies between assemblies 400*a* and 400*b*. In general, radio processors 412 receive incoming signals from antennas and transmit the processed incoming signals to baseband processors 408. Radio processors 412 also receive outgoing signals from baseband processors 408 and apply the outgoing signals to the antennas for transmission. To that end, each assembly 400 also includes an antenna assembly 100*a*, 100*b*. Antenna assemblies 100*a* and 100*b* are as described above, with certain exceptions set forth below.

Further, each assembly 400 includes a communications interface 416*a*, 416*b* connected to baseband processors 408*a*, 408*b* respectively (e.g. via traces and vias on assembly support members 404*a*, 404*b*). Communications interfaces 416 permit connection of assemblies 400 to a variety of computing devices and enable such computing devices to communicate using the wireless communication standard implemented by assemblies 400 (such as the WiGig standard). Communications interfaces 416 are, in the present embodiment, universal serial bus (USB) connectors. A wide variety of other interfaces may be employed, however, including other wired interfaces (e.g. Ethernet).

Figure 5A:
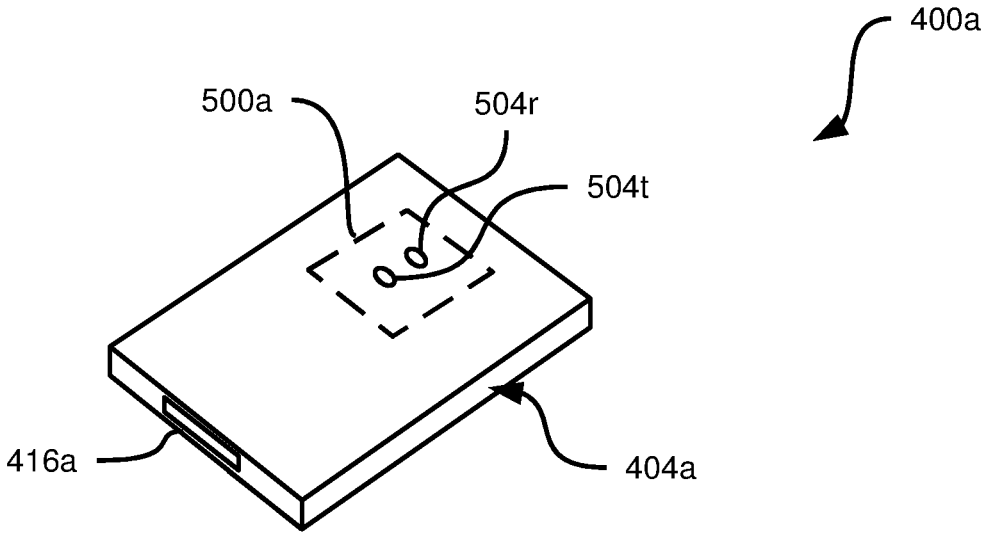
FIG. 5A depicts a partial isometric view of the wireless communications assembly of FIG. 4A, according to a non-limiting embodiment.
Figure 5B:
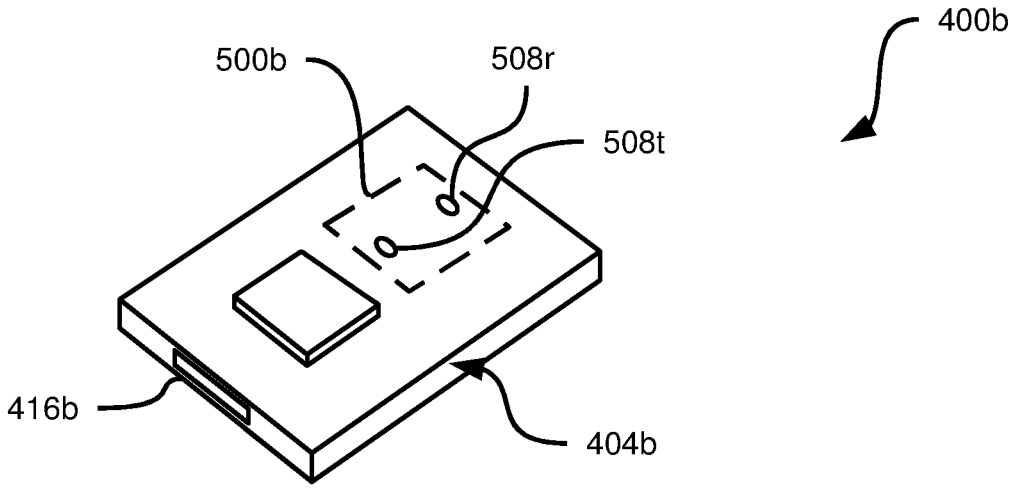
FIG. 5B depicts a partial isometric view of the wireless communications assembly of FIG. 4B, according to a non-limiting embodiment.

Turning to FIGS. 5A and 5B, assemblies 400*a* and 400*b*, respectively, are shown with antenna assemblies 100*a* and 100*b* omitted. As seen in FIGS. 5A and 5B, each assembly support member 404 also defines a mounting surface 500*a*, 500*b* thereon. Mounting surfaces 500*a* and 500*b* serve as locations to mount antenna assemblies 100*a* and 100*b*, respectively, to assemblies 400*a* and 400*b*. Antenna assemblies 100*a* and 100*b* can be mounted using any suitable technology, such as BGA.

Mounting surfaces 500*a* and 500*b* each include a set of host electrical contacts. Specifically, mounting surface 500*a* includes a pair of contacts 504*r* and 504*t*. As shown in FIG. 4A, when antenna assembly 100*a* is mounted to mounting surface 500*a*, contact 200*t* is electrically connected with contact 504*t*, and contact 200*r* is electrically connected with contact 504*r*. Radio processor 412*a* is mounted on an opposite side of support member 404*a* from antenna assembly 100*a*, and is electrically connected to contacts 504 (and therefore to antenna 116) by one or more vias 420.

Mounting surface 500*b* includes a pair of contacts 508*r* and 508*t*. Turning to FIG. 4B, radio processor 412*b* is mounted to support member 104 of antenna assembly 100*b* rather than directly to assembly support member 404*b*. Therefore contacts 200*r* and 200*t* are electrically connected to corresponding contacts on radio processor 412*b*. In order to electrically connect radio processor 412*b* to baseband processor 408*b*, antenna assembly 100*b* includes two additional, or auxiliary, sets of contacts: a first set that is electrically connected with contacts 508*r* and 508*t* when antenna assembly 100*b* is mounted to mounting surface 500*b*, and a second set that is electrically connected to additional contacts on radio processor 412*b*. Thus, a signal from baseband processor 408*b* are carried via suitable combinations of traces and vias in support member 404*b* to contact 508*t* (which may be implemented as multiple contacts in other embodiments). The signal is then transmitted, via support member 104 of antenna assembly 104*b* (and specifically via the two sets of additional contacts mentioned above), to radio processor 412*b*. Radio processor 412*b* then transmits the processed signal to antenna 116 (specifically, element 120*t*) via contact 200*t*.

Radiation received at antenna 116 is converted to a received signal and communicated to radio processor 412*b* via contact 200*r*. Radio processor 412*b* then performs any necessary processing of the signal and transmits the processing inbound signal to baseband processor 408*b* via the second additional set of contacts mentioned above, followed by the first additional set of contacts and contact 508*r*.

As seen in FIGS. 4A and 4B, radio processors 412 and baseband processors 408 can be placed on the same side of support member 404 as antenna assemblies 100, or on the opposite side. In some implementations, particularly those with stringent size constraints, it may be preferable to place the antenna assembly on the side opposite the radio and baseband processors, to provide sufficient space for the antenna assembly's placement as well as for reduction of interference with antenna performance by other components.

Figure 6A:
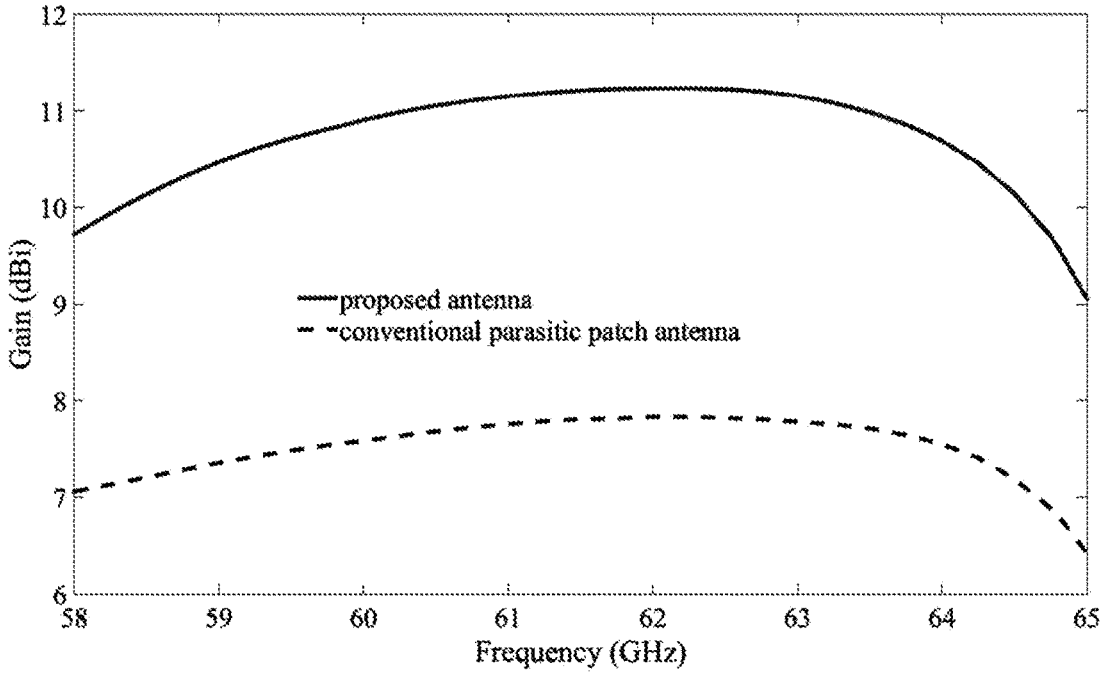
FIG. 6A depicts the gain of the antenna assembly of FIG. 1 compared to that of a conventional parasitic patch antenna.
Figure 6B:
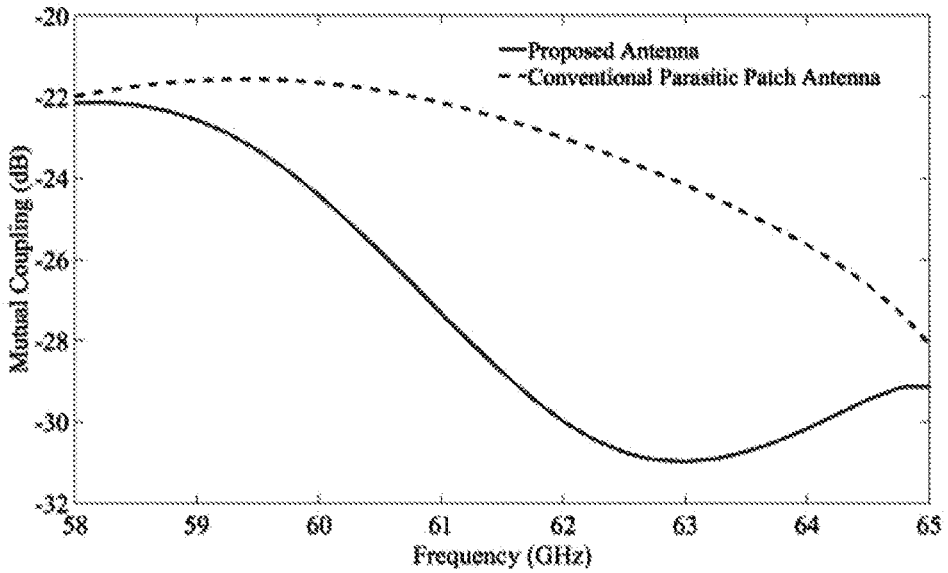
FIG. 6B depicts the mutual coupling performance of the antenna assembly of FIG. 1 compared to that of a conventional parasitic patch antenna.

Referring now to FIG. 6A, the gain achieved by an example implementation of antenna assembly 100 is illustrated in comparison to that of a conventional parasitic patch antenna (i.e. lacking inner ring 128 and outer ring 140). FIG. 6B, meanwhile, depicts a comparison of the level of mutual coupling experienced by the same example implementation of antenna assembly 100 with the level of mutual coupling experienced by the same conventional parasitic patch antenna. Mutual coupling refers to the undesired receipt, at the reception elements of the antenna, of transmitted signals generated by the transmission elements of the antenna. As seen in FIG. 6B, in the 60 GHz band antenna assembly 100 achieves either equal or lower levels of mutual coupling as those for the conventional antenna.

Various advantages to the assemblies discussed herein will now occur to those skilled in the art. For example, antenna assembly 100 may provide increased gain (over a conventional patch antenna) comparable with an antenna array, while avoiding at least some of the disadvantages of the array (e.g. complexity of manufacturing, mutual coupling, impedance bandwidth limitations).

The scope of the claims should not be limited by the embodiments set forth in the above examples, but should be given the broadest interpretation consistent with the description as a whole.

The invention claimed is:

1. An antenna assembly, comprising:

a support member having (i) a first surface, (ii) an opposing second surface configured to couple the antenna assembly to an antenna assembly support member, and (iii) a set of electrical contacts;

an antenna carried on the first surface of the support member and electrically connected to the set of electrical contacts, the antenna including (i) a powered element and (ii) a parasitic element;

a conductive inner ring element carried on the first surface and surrounding the antenna; and a dielectric outer ring element mounted on the first surface and surrounding the conductive inner ring; wherein the dielectric outer ring has an inside perimeter that surrounds an outside perimeter of the conductive inner ring element.

2. The antenna assembly of claim 1, wherein the powered element includes:

a transmission element connected to a first of the set of electrical contacts; and a reception element connected to a second of the set of electrical contacts.

3. The antenna assembly of claim 2, each of the transmission element and the reception element comprising a patch element.

4. The antenna assembly of claim 3, wherein the parasitic element includes:

a transmission parasitic patch element; and a reception parasitic patch element.

5. The antenna assembly of claim 3, wherein the parasitic element includes:

a pair of transmission parasitic patch elements disposed on opposite sides of the transmission element; and a pair of reception parasitic patch elements disposed on opposite sides of the reception element.

6. The antenna assembly of claim 2, the conductive inner ring element continuously surrounding the antenna.

7. The antenna assembly of claim 2, the conductive inner ring element separately surrounding each of the transmission element and the reception element.

8. The antenna assembly of claim 2, the support member further comprising a ground plane; the conductive inner ring element connected to the ground plane by a plurality of ground vias.

9. The antenna assembly of claim 1, the dielectric outer ring element having an inner perimeter in contact with an outer perimeter of the conductive inner ring element.

10. The antenna assembly of claim 1, the support member comprising a first dielectric material.

11. The antenna assembly of claim 10, the dielectric outer ring element comprising a second dielectric material different from the first dielectric material.

12. The antenna assembly of claim 1, the dielectric outer ring element comprising a wall rising from the first surface of the support member.

13. The antenna assembly of claim 1, the set of electrical contacts disposed on the second surface of the support member.

14. A wireless communications assembly, comprising:

an assembly support member carrying a baseband processor; the assembly support member defining a mounting surface including a set of host electrical contacts;

a communications interface carried by the assembly support member and connected with the baseband processor; and an antenna assembly having:

a support member having opposing first and second surfaces, and a set of electrical contacts, the second surface of the support member coupled to the mounting surface of the assembly support member;

an antenna carried on the first surface of the support member and electrically connected to the set of electrical contacts, the antenna including (i) a powered element and (ii) a parasitic element;

a conductive inner ring element carried on the first surface and surrounding the antenna; and a dielectric outer ring element mounted on the first surface and surrounding the conductive inner ring; wherein the dielectric outer ring has an inside perimeter that surrounds an outside perimeter of the conductive inner ring element.

15. The wireless communications assembly of claim 14, the host electrical contacts being electrically connected to the set of electrical contacts of the support member.

16. The wireless communications assembly of claim 15, further comprising:

a radio processor connected to the baseband processor;

wherein the set of host electrical contacts are electrically connected to the radio processor.

17. The wireless communications assembly of claim 16, the mounting surface defined on a first side of the assembly support member, and the baseband processor and the radio processor being supported on an opposing second side of the assembly support member.

18. The wireless communications assembly of claim 14, further comprising:

the support member further comprising an auxiliary set of electrical contacts connected to the set of host electrical contacts;

a radio processor supported by the support member to connect the radio processor to the set of electrical contacts and the set of auxiliary electrical contacts.

19. The wireless communications assembly of claim 18, wherein the set of electrical contacts and the set of auxiliary electrical contacts are disposed on the second surface of the support member;

the radio processor connected to the second surface of the support member.

20. The wireless communications assembly of claim 19, the baseband processor and the support member being connected to the same side of the assembly support member.

* * * * *